US006922099B2

(12) United States Patent
Shor et al.

(10) Patent No.: US 6,922,099 B2
(45) Date of Patent: Jul. 26, 2005

(54) CLASS AB VOLTAGE REGULATOR

(75) Inventors: Joseph S. Shor, Tel Mond (IL); Yoram Betser, Mazkeret Batya (IL)

(73) Assignee: Saifun Semiconductors Ltd., Netanya (IL)

( * ) Notice: Subject to any disclaimer, the term of this patent is extended or adjusted under 35 U.S.C. 154(b) by 0 days.

(21) Appl. No.: 10/689,054

(22) Filed: Oct. 21, 2003

(65) Prior Publication Data

US 2005/0083112 A1 Apr. 21, 2005

(51) Int. Cl.[7] ..... G05F 1/10; G05F 3/02
(52) U.S. Cl. ..... 327/543; 327/541; 323/316
(58) Field of Search ..... 327/538, 540–541, 327/543, 545, 546; 323/280, 315–316, 273

(56) References Cited

U.S. PATENT DOCUMENTS

| | | | | |
|---|---|---|---|---|
| 5,636,288 A | | 6/1997 | Bonneville et al. | 381/110 |
| 5,726,946 A | | 3/1998 | Yamagata et al. | 365/226 |
| 5,847,441 A | | 12/1998 | Cutter et al. | 257/530 |
| 5,861,771 A | * | 1/1999 | Matsuda et al. | 327/540 |
| 5,903,031 A | | 5/1999 | Yamada et al. | 257/356 |
| 5,963,412 A | | 10/1999 | En | 361/111 |
| 6,011,725 A | | 1/2000 | Eitan | 365/185.33 |
| 6,028,324 A | | 2/2000 | Su et al. | 257/48 |
| 6,081,456 A | | 6/2000 | Dadashev | 365/185.23 |
| 6,285,246 B1 | * | 9/2001 | Basu | 327/541 |
| 6,407,537 B2 | * | 6/2002 | Antheunis | 323/312 |

FOREIGN PATENT DOCUMENTS

EP 0693781 1/1996

OTHER PUBLICATIONS

P. E. Allen and D. R. Holberg in "*CMOS Analog Circuit Design*" (Oxford University Press, 2002), pp. 259.
J. S. Shor, Y. Sofer, Y. Polansky, and E. Maayan, in *ISCAS 2002*, Phoenix, Arizona.

* cited by examiner

*Primary Examiner*—Quan Tra
(74) *Attorney, Agent, or Firm*—Eitan Law Group

(57) ABSTRACT

Circuitry including a voltage regulator including a first stage and a second stage, wherein an output of the first stage is coupled to an input of the second stage, wherein current of the second stage is mirrored through a current path to a current mirror driver, the current mirror driver adapted to perform a first Class AB action including at least one of sourcing and sinking current from a voltage supply VPP, wherein an output of the current mirror driver is connected to an output of the voltage regulator, and a first circuit connected to the current path and adapted to sample current in the current path, wherein during steady state current in the current path, the first circuit provides negligible current to the output of the voltage regulator, and during transient current conditions, the first circuit performs a second Class AB action complementary to the first Class AB action including at least one of sinking and sourcing current from the voltage supply VPP.

8 Claims, 6 Drawing Sheets

CLASS AB VOLTAGE REGULATOR

FIELD OF THE INVENTION

The present invention relates generally to voltage regulators, and particularly to a Class AB (sinking and sourcing) voltage regulator without a Miller architecture, which may be used, without limitation, for fast discharge of high capacitances suitable for regulation or switching of voltages in operation of memory cell arrays, such as regulation of voltages for programming such arrays.

BACKGROUND OF THE INVENTION

Non-volatile memory (NVM) arrays, such as erasable, programmable read only memory (EPROM) or flash memory arrays, or electrically erasable, programmable read only memory (EEPROM) arrays, require high positive or negative voltages to program and erase memory cells of the array. NVM cells generally comprise transistors with programmable threshold voltages. For example, one type of non-volatile cell is a nitride, read only memory (NROM) cell, described in U.S. Pat. No. 6,011,725, the disclosure of which is incorporated herein by reference.

One preferred procedure for programming bits, e.g., in NROM cells, is by the application of programming pulses to word lines and bit lines so as to increase the threshold voltage of the bits to be programmed. After application of one or more sets of programming pulses, the threshold voltages of the bits that are to be programmed may be verified to check if the threshold voltages have been increased to a target programmed state. Any bit that fails the program verify operation should preferably undergo one or more extra programming pulses. The sequence of application of programming pulses followed by verification may then continue until all the bits that should be programmed have reached the target programmed state.

Read and write operations are typically carried out with voltages that are regulated above a positive voltage supply Vdd. The circuitry that supplies and controls the programming and verification voltages generally comprises a high voltage regulator or high voltage pump (the terms being used herein interchangeably). A typical EPROM system is shown in FIG. 1. A charge pump 5 pumps a voltage supply Vpp to a voltage amplifier (also called a differential stage) 6. Differential stage 6 receives an input voltage REF at one of its inputs (the positive input in the illustration). The output of differential stage 6 may be connected via a node n1 to an inverter 7. The inverter 7 may be connected to a negative and/or ground drive, and through a capacitor 8 back to the second input (the negative input in the illustration) of differential stage 6 as its feedback FB. An X-decoder (XDEC) 9 may also be connected to inverter 7. The circuitry of FIG. 1 may drive the voltages for word lines (WL) of an array, which also includes bit lines (BL).

For example, it may be necessary to drive the word line to which the gate of a memory transistor (or cell) is connected to different voltage levels in order to read, program or erase it The load to be driven includes the word line, X-decoder (XDEC) and associated N-wells. This may be a very large capacitive load for a VLSI (very large scale integrated) circuit, ranging in value from 100 pF to several nF. During program (PGM) mode, the word line and associated voltages may be typically at a programming voltage (Vpgm) in the range of 8 to 11V, whereas in read (RD) or verify (VERF) modes, the word line may be typically at a read voltage (Vrd) in the range of 3 to 6V. The regulator may have to drive the voltage transition between the different modes in a short time span (0.1–2 $\mu$s).

Conventional voltage regulators use the well-known Miller architecture, a typical example of which is illustrated in FIG. 2.

An NMOS (n-channel metal oxide semiconductor) transistor XA1A has its gate connected to an input BGREF, its drain connected to a node N1, and its source connected to a node N2. A PMOS (p-channel metal oxide semiconductor) transistor XA2A has its gate connected to a node MG, its drain connected via node N1 to the drain of NMOS transistor XA1A, and its source connected to some reference voltage. Another PMOS transistor XA2B has its gate connected via node MG to the gate of PMOS transistor XA2A, its drain connected via nodes N4 and MG to its gate, and its source connected to some reference voltage.

An NMOS transistor XA3A has its drain connected via node N2 to the source of NMOS transistor XA1A, its gate connected to the gate of an NMOS transistor XA3B, and its source may be grounded. NMOS transistor XA3B has its gate and drain connected to a node N3, and its source may be grounded. Node N3 is connected to a current source I1.

An NMOS transistor XA1B has its drain connected via node N4 to the drain of PMOS transistor XA2B, its gate connected to a node N5, and its source connected via node N2 to the drain of NMOS transistor XA3A.

Another PMOS transistor XA4 has its gate connected to a node N6, its drain connected to a node N7, and its source connected to some reference voltage. A resistor R0 may be connected between nodes N5 and N7, and another resistor R1 may be connected between node N5 and ground. Resistors R0 and R1 form a resistive divider. A capacitance load Cload may be connected to node N7 via a node N8, and may be grounded. The output node is designated as OP.

The circuitry of transistors XA1A, XA2A, XA3A, XA3B, XA1B and XA2B forms the first stage of the Miller architecture, and the circuitry of transistor XA4 forms the second stage of the Miller architecture, with feedback FB from node N5 to the gate of transistor XA1B. A Miller compensating capacitor CM is connected between nodes N6 and N7. PG is the input to the second stage (gate of transistor XA4). The dominant (primary) pole is at node N6 and the secondary pole is at node N7.

The Miller architecture may be problematic in many EPROM applications, wherein the capacitance load Cload is large. This is because the non-dominant pole, referred to as p2 (node N7), is associated with the output node (OP) (via node N8). Using an open loop analysis (see, for example, P. E. Allen and D. R. Holberg in "CMOS Analog Circuit Design" (Oxford University Press, 2002), pp. 259), the condition for stability is that p2 be greater than or equal to 3 times the unity gain bandwidth (GBW):

$$p2 > 3 \times GBW \quad \text{(Eq. 1)}$$

wherein p2=gm2/Cload (Eq. 2) and GBW=gm1/Cm (Eq. 3), assuming a unity gain buffer, i.e., FB=OP, and wherein the transconductances of the first and second stages are gm1 and gm2 respectively.

The stability condition implies that the non-dominant pole, which in this case includes a very large output capacitor, will ultimately set the bandwidth.

There are a large variety of Class AB drivers reported in the literature. These include circuits that increase the tail current when a signal is present (see, for example, R. Klinke, B. J. Hosticka, and H. Pfleiderer, IEEE J. Solid State Circuits 24, pp. 744–746 (1989)). Others use a transistor biased near Vt and increase the Vgs when necessary (see, for example,) B. Fotouhi, IEEE J. Solid State Circuits 38, pp. 226–236 (2003)). Class AB operation can also be achieved using back-to-back source followers (see, for example, J. S. Shor, Y. Sofer, Y. Polansky, and E. Maayan, in ISCAS 2002: International Symposium on Circuits and Systems, paper # WA2.04.01, May 26–29, 2002, Phoenix, Ariz.). The Class AB architectures typically use either a Miller configuration, or are single stage regulators.

SUMMARY OF THE INVENTION

The present invention seeks to provide a novel voltage regulator without a Miller architecture, as is described more in detail hereinbelow.

There is thus provided in accordance with an embodiment of the present invention circuitry including a voltage regulator including a first stage and a second stage, wherein an output of the first stage is coupled to an input of the second stage, wherein current of the second stage is mirrored through a current path to a current mirror driver, the current mirror driver adapted to perform a first Class AB action including at least one of sourcing and sinking current from a voltage supply VPP, wherein an output of the current mirror driver is connected to an output of the voltage regulator, and a first circuit connected to the current path and adapted to sample current in the current path, wherein during steady state current in the current path, the first circuit provides negligible current to the output of the voltage regulator, and during transient current conditions, the first circuit performs a second Class AB action complementary to the first Class AB action including at least one of sinking and sourcing current from the voltage supply VPP.

In accordance with an embodiment of the present invention the first stage includes a differential stage and the second stage includes an inverting stage, and the input of the second stage is a gate of an MOS transistor.

Further in accordance with an embodiment of the present invention the output of the voltage regulator is connected to a capacitance load.

Still further in accordance with an embodiment of the present invention the capacitance load includes at least one of a wordline and a wordline driver of a memory array.

In accordance with an embodiment of the present invention the output of the first stage is coupled to the gate of the second stage without a Miller compensating capacitor.

Further in accordance with an embodiment of the present invention the voltage regulator and the first and second stages form a two pole system based on an anti-Miller principle.

Still further in accordance with an embodiment of the present invention the first and second stages both operate from a voltage supply VDD, which is at a lower voltage than VPP.

In accordance with an embodiment of the present invention, the circuitry further includes an NMOS transistor M1B whose gate is connected to an input BGREF, whose drain is connected to a node N10, and whose source is connected to a node N11, a current source I1 connected to the node N11 and which is grounded, an NMOS transistor M1A whose source is connected to the node N11, whose gate is connected to a node N12, and whose drain is connected via a node N13 to the drain of a PMOS transistor M2A, wherein the PMOS transistor M2A has its gate connected via the node N13 to its drain, and whose source is connected to voltage VDD, and a PMOS transistor M2B whose gate is connected to the gate of the PMOS transistor M2A, whose drain is connected to the node N10, and whose source is connected to voltage VDD, and further includes a PMOS transistor M3 whose drain is connected to a node N14, whose source is connected to voltage VDD, and whose gate PG is connected to the first stage at the node N10, an NMOS transistor M4A whose gate and drain are connected to the node N14, and whose source is grounded, an NMOS transistor M4B whose drain is connected to a node N15, whose gate is connected to the gate of the NMOS transistor M4A, and whose source is grounded, an NMOS transistor M4C whose drain is connected to a node N16, whose gate is connected to the gate of the NMOS transistor M4B, and whose source is grounded, a current source I2, one node of which is connected to the node N16, and another node of which is connected to voltage VDD, a pair of NMOS transistors M6A and M6B whose gates are connected together and to node N16 and whose sources are grounded, wherein the drain of the NMOS transistor M6A is connected to its gate and the drain of the NMOS transistor M6B is connected to the output of the voltage regulator, a pair of PMOS transistors M5A and M5B whose gates are connected together and to node N15 and whose sources are connected to VPP, the drain of the PMOS transistor M5A being connected to the node N15, and the drain of the PMOS transistor M5B being connected to the output of the voltage regulator, and a resistor divider including a first resistor R0 connected between the output of the voltage regulator and a node N12, and a second resistor R1 connected between the node N12 and ground, wherein the first stage includes the current source I1, the transistors M1A, M1B, M2A and M2B, the second stage includes the transistor M2, the current path includes the transistors M4A and M4B, and the current mirror driver includes the PMOS transistors M5A and M5B, and the first circuit includes the NMOS transistors M4C, M6A, M6B and the current source I2.

In accordance with an embodiment of the present invention, the circuitry further includes an NMOS transistor M1B whose gate is connected to an input "neg", whose drain is connected to a node N10, and whose source is connected to a node N11, a current source I1 connected to the node N11 and which is grounded, an NMOS transistor M1A whose source is connected to the node N11, whose gate is connected to an input "pos", and whose drain is connected via a node N13 to the drain of a PMOS transistor M2A, wherein the PMOS transistor M2A has its gate connected via the node N13 to its drain, and whose source is connected to voltage VDD, and a PMOS transistor M2B whose gate is connected to the gate of the PMOS transistor M2A, whose drain is connected to the node N10, and whose source is connected to voltage VDD, and further includes a PMOS transistor M3 whose drain is connected to a node N14, whose source is connected to voltage VDD, and whose gate PG is connected to the first stage at the node N10, an NMOS transistor M4A whose gate and drain are connected to the node N14, and whose source is grounded, an NMOS transistor M4C whose drain is connected to a node N16, whose gate is connected to the gate of the NMOS transistor M4A, and whose source is grounded, an NMOS transistor M4B whose drain is connected to a node N20, whose gate is connected to the gate of the NMOS transistor M4C, and whose source is grounded, a current source I11 one node of which is connected to a node N20, and another node of which is connected to voltage VPP, a pair of NMOS transistors M6A and M6B whose gates are connected to each other and to node N16 via NG, and whose sources grounded, wherein the drain of the NMOS transistor M6A is connected to its gate and the drain of the NMOS transistor M6B is connected to the drain of a PMOS transistor M5A, a current source I2 one node of which is connected to the node N16, and another node of which is connected to voltage VDD, a pair of PMOS transistors M5A and M5B whose gates are connected to each other and to node N15 and whose sources are connected to VPP, wherein the drain of the PMOS transistor M5A is connected to its gate and the drain of the PMOS transistor M5B is connected to the output of the voltage regulator, wherein the first stage includes the current source I1, the transistors M1A, M1B, M2A and M2B, the second stage includes the transistor M3, the current mirror driver and current path include the transistors M4A and M4B, and the first circuit includes the NMOS transistors M4C, M6A, M6B, PMOS transistors M5A and M5B and the current source I2.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 2:
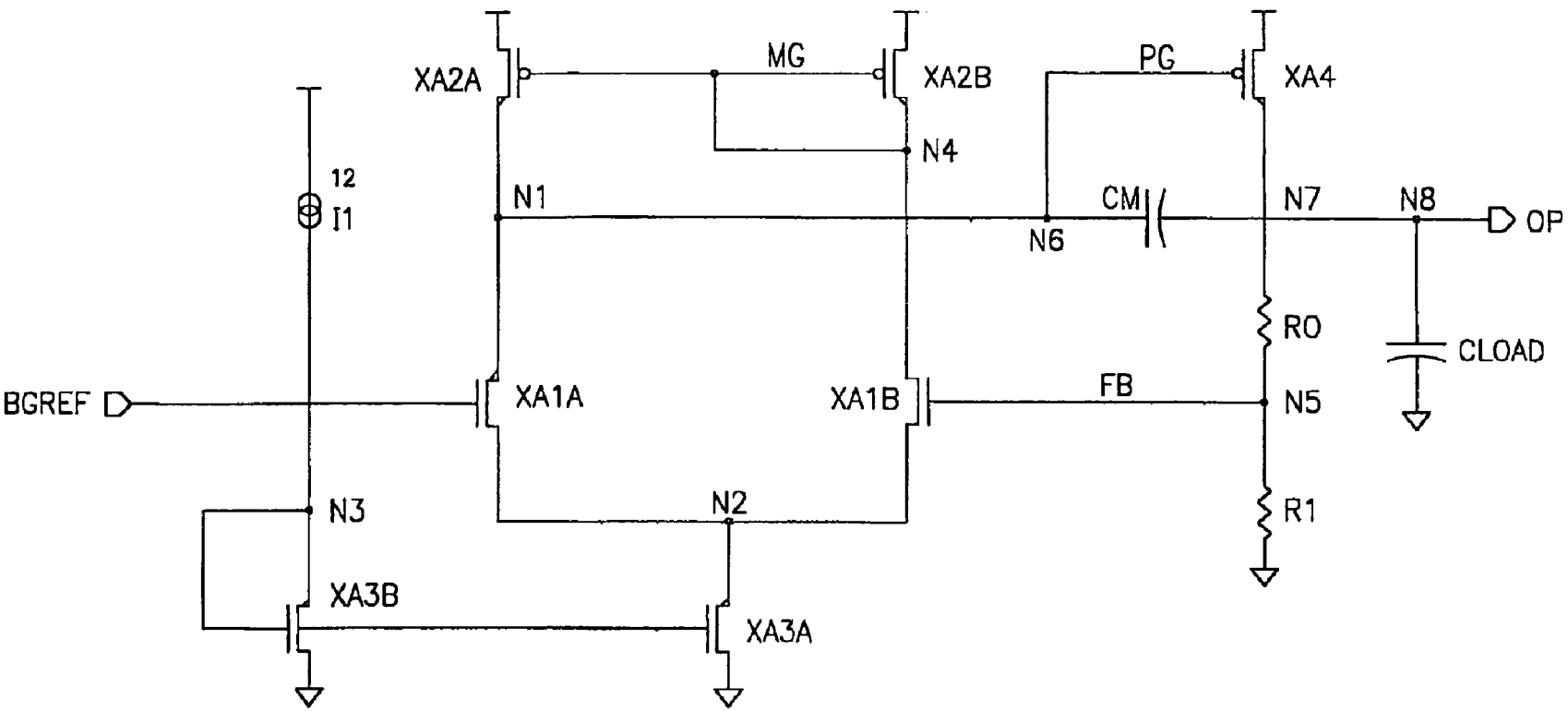
FIG. 2 is a simplified block diagram of a voltage regulator with a Miller architecture, typically used in the prior art to drive the voltages required for program and read/verify.
Figure 3:
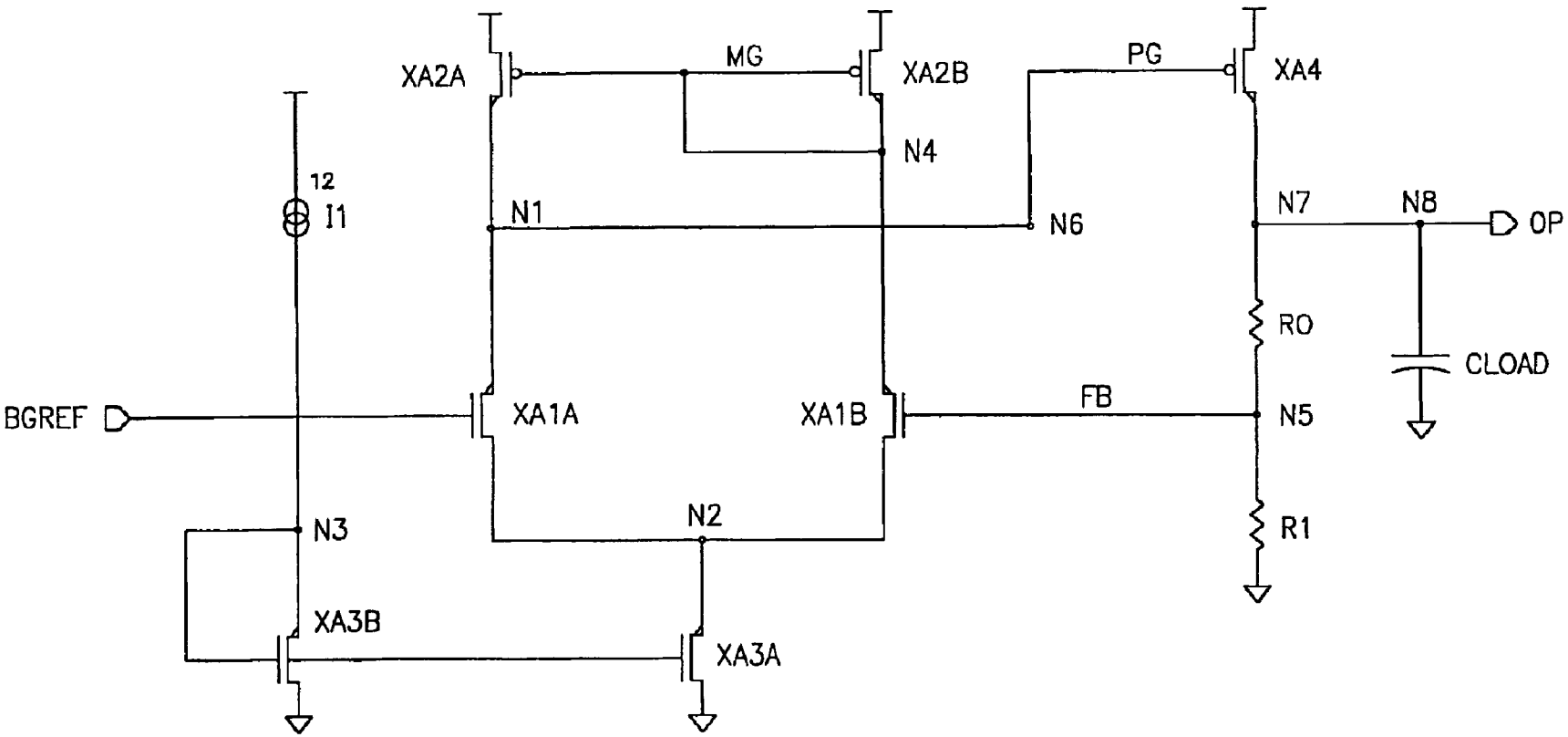
FIG. 3 is a simplified block diagram of a voltage regulator without a Miller architecture, in accordance with an embodiment of the present invention.

Reference is now made to FIG. 3, which illustrates a simplified block diagram of a voltage regulator without a Miller architecture, in accordance with an embodiment of the present invention. Components of the circuitry of FIG. 3 that are similar to that of FIG. 2 are designated with the same reference labels, and the description is not repeated for the sake of brevity.

The Miller architecture of FIG. 2 is a 2-pole system. The dominant (primary) pole is at node N6 and the secondary pole is at node N7. In the voltage regulator of FIG. 3, the poles are reversed. There is no Miller capacitor CM and the capacitance at the input (PG) to the second stage is minimized. The dominant primary) pole is at node N7 and the secondary pole is at node N6. The reversal of the poles may achieve a higher bandwidth. The primary pole at node N7 is set by the output capacitor Cload and the secondary pole at node N6 is set at the high impedance of PG. The secondary pole at node N6, which determines the bandwidth, is defined as:

$$p2=[R_{O1}*C(pg)]^{-1}, \quad \text{(Eq. 4)}$$

wherein $R_{O1}$ is the drain resistance of NMOS transistor XA4 driving PG and C(pg) is the capacitance at node N6. This requires relatively low output impedance at the differential stage, which is connected to node N6. Although node N6 may be considered a "high impedance" node, nevertheless its impedance is low relative to the dominant pole at node N7 such that the pole associated with node N6 is at high frequencies. The gain bandwidth GBW is derived as:

$$GBW=gm1*Z1*gm2*K_R/\text{Cload} \quad \text{(Eq. 5)}$$

$$\text{wherein } Z1=R_{O1} \quad \text{(Eq. 6)}$$

$$\text{and } K_R=R1/(R0+R1)=\text{the divider ratio} \quad \text{(Eq. 7)}$$

C(pg) is neglected in equations 5 and 6 since it is assumed small compared to the output resistance. Applying the stability condition of equation 1, one derives:

$$gm1*gm2*(R_{O1})^2*K_R*Cpg/\text{Cload}<⅓ \quad \text{(Eq. 8)}$$

Since (RO1)2~1/I (I being the current at node N6), while gm1~SQRT(I), the first stage preferably has a low output resistance Rout (e.g., small lengths) and high current (e.g., ~100–200 $\mu$A) for stability, which also places p2 at high frequencies and enables high bandwidth. The gm2/Cload ratio is preferably minimized. This may be appropriate for driving the word lines in the case of Cload being large.

The architecture of FIG. 3 is coined an "Anti-Miller" architecture, since it is a two-stage regulator, hence a 2-pole system, with no Miller capacitor. Each stage contributes a pole at its high impedance output (N6 and N7). As stated previously, the first stage output resistance preferably has a low output resistance Rout and preferably has a high transconductance (GM). The second stage preferably has a low transconductance GM and drives a large capacitor (Cload), which may provide stability. In the Miller regulator of the prior art, the situation is reversed, since the first stage needs a low GM, the second stage a high GM, and the output capacitor detracts from the stability.

One advantage of the "anti-Miller" regulator of FIG. 3 is that it provides much higher bandwidth when driving large capacitive loads. It also has a very high PSRR (power supply rejection ratio) at frequencies near the unity gain and at all frequencies. The Miller regulator has a poor PSRR near the unity gain frequency.

Thus, in the architecture of the voltage regulator of FIG. 3, the second stage is the weaker one, and as such, the gate voltage, PG, exhibits a large voltage and current deviation between steady state and transient conditions.

In a typical NVM array, the WL voltages are usually above VDD, and the voltages are usually attained by pumping from a supply (VPP). The pumping process is inherently wasteful, having as much as a 1:10 ratio between VDD current and VPP current. This requires minimal current consumption from the VPP source. For the very large output capacitances (>500 pF), it may be desirable to have a Class AB driver, or push pull driver, as the resistive divider (FIG. 3) alone may not provide enough pull-down current. In a Class AB driver, the driver can increase both the sourcing (push) and sinking (pull) currents during transient conditions, relative to the quiescent, or steady-state conditions. The difference between a Class AB regulator and a normal (e.g. class A or class B) regulator is as follows. In a normal regulator, one of the sourcing and sinking (or push, pull) drivers is fixed during both steady state and transient conditions, while the driver providing the complementary action, e.g. sinking or sourcing respectively, provides increased current in transient conditions relative to the steady state current. In a Class AB driver, both the sourcing and sinking drivers are capable of providing increased current in transient conditions according to the need of the output, relative to the steady state or quiescent condition. This allows both the pushing and pulling action of the Class AB driver to be done very fast with low quiescent current. In Class A or Class B, only one of the two complementary actions (pushing or pulling) is fast, while the second is done within the limits of the quiescent currents.

Figure 4:
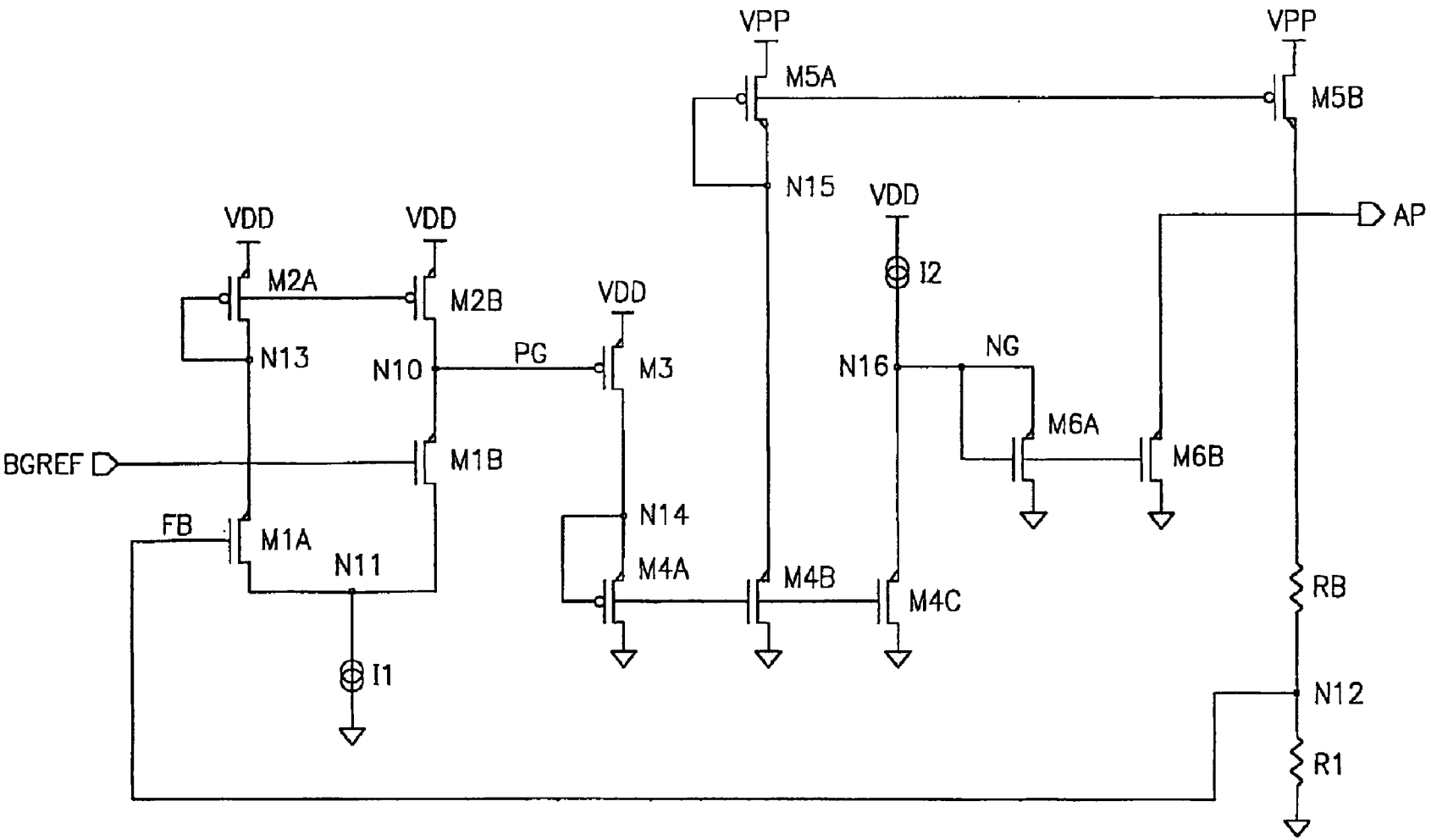
FIG. 4 is a simplified block diagram of circuitry for a Class AB voltage driver incorporating the voltage regulator of FIG. 3, in accordance with an embodiment of the invention.

Reference is now made to FIG. 4, which illustrates a simplified block diagram of circuitry for a Class AB voltage driver incorporating the voltage regulator of FIG. 3, in accordance with an embodiment of the invention.

In one non-limiting embodiment, an NMOS transistor M1B may have its gate connected to an input BGREF, its drain connected to a node N10, and its source connected to a node N11. A current source I1 may be connected to node N11 and is grounded. An NMOS transistor M1A may have its source connected to node N11, its gate connected to a node N12, and its drain connected via a node N13 to the drain of a PMOS transistor M2A. PMOS transistor M2A may have its gate connected via node N13 to its drain, and its source may be connected to voltage VDD. A PMOS transistor M2B may have its gate connected to the gate of PMOS transistor M2A, its drain to node N10, and its source may be connected to voltage VDD. The above components make up the first (differential) stage of the Class AB driver.

The differential stage may be connected to a second (inverting) stage comprising PMOS transistor M3. The inverting stage is connected to the output via a current path that may comprise the components now described in the following paragraphs. It is noted that the current path may include, without limitation, a direct connection between the inverting stage and the output. The current path may comprise an indirect connection between the inverting stage and the output, wherein the indirect connection may comprise, without limitation, current mirrors or folding elements.

The node N10 of the first stage may be connected at PG, that is, to the gate of a PMOS transistor M3, which has its drain connected to a node N14, and its source to VDD. An NMOS transistor M4A may have its gate and drain connected to node N14, and its source may be grounded. An NMOS transistor M4B may have its drain connected to a node N15, its gate connected to the gate of NMOS transistor M4A, and its source may be grounded. An NMOS transistor M4C may have its drain connected to a node N16, its gate connected to the gate of NMOS transistor M4B, and its source may be grounded. A current source I2 may be connected to node N16, and the other node of current source I2 may be connected to VDD.

A pair of NMOS transistors M6A and M6B may have their gates connected and their sources grounded. The drain of NMOS transistor M6A may be connected to its gate via a node ng connected to node N16. The drain of NMOS transistor M6B may be connected to the output node OP. A pair of PMOS transistors M5A and M5B may have their gates connected and their sources connected to VPP. The drain of PMOS transistor M5A may be connected to node N15. The drain of PMOS transistor M5B may be connected to the output node OP.

A resistor R0 may be connected between nodes OP and N12, and another resistor R1 may be connected between node N12 and ground. Resistors R0 and R1 form a resistive divider.

The first differential stage, which draws relatively high current, may be operated from VDD, and the current path of the second inverting stage may be mirrored to the VPP supply by the current mirror driver comprising PMOS transistors M5A and M5B, which drives the resistor current during steady-state conditions. (As is known in the art, a current mirror receives a current at its input, and sources or sinks an identical or multiplied current at its output.) PMOS transistors M5A and M5B are preferably scaled. The Class AB action (that is, sourcing (pushing down current) and sinking (pulling up current)) may be accomplished by the circuit formed of NMOS transistors M4C, M6A, M6B and current source I2. In steady state conditions, the circuit may provide (i.e. source or sink) negligible (that is, insignificant or no) current to the output. During transient conditions, NMOS transistor M6B may sink large currents from the output as necessary. During steady state conditions, current source I2 may have approximately half the current of NMOS transistor M4C, and the gates of NMOS transistors M6A and M6B may be grounded. When a pull down action is required, the strong first stage may drive PG up, thus significantly decreasing or zeroing the current in PMOS transistor M3. At this point most or all of the current in current source I2 may be mirrored to the output. The multiplication factor between NMOS transistors M6A and M6B may determine the pull-down or sinking drive. The strong pull-up, or sourcing, ability may be provided by NMOS transistor M3, whose current may be multiplied by a large factor during transient conditions, when the output capacitor is large enough (>500 pF) to allow a relatively high gm2 (in accordance with equation 8).

Figure 1:
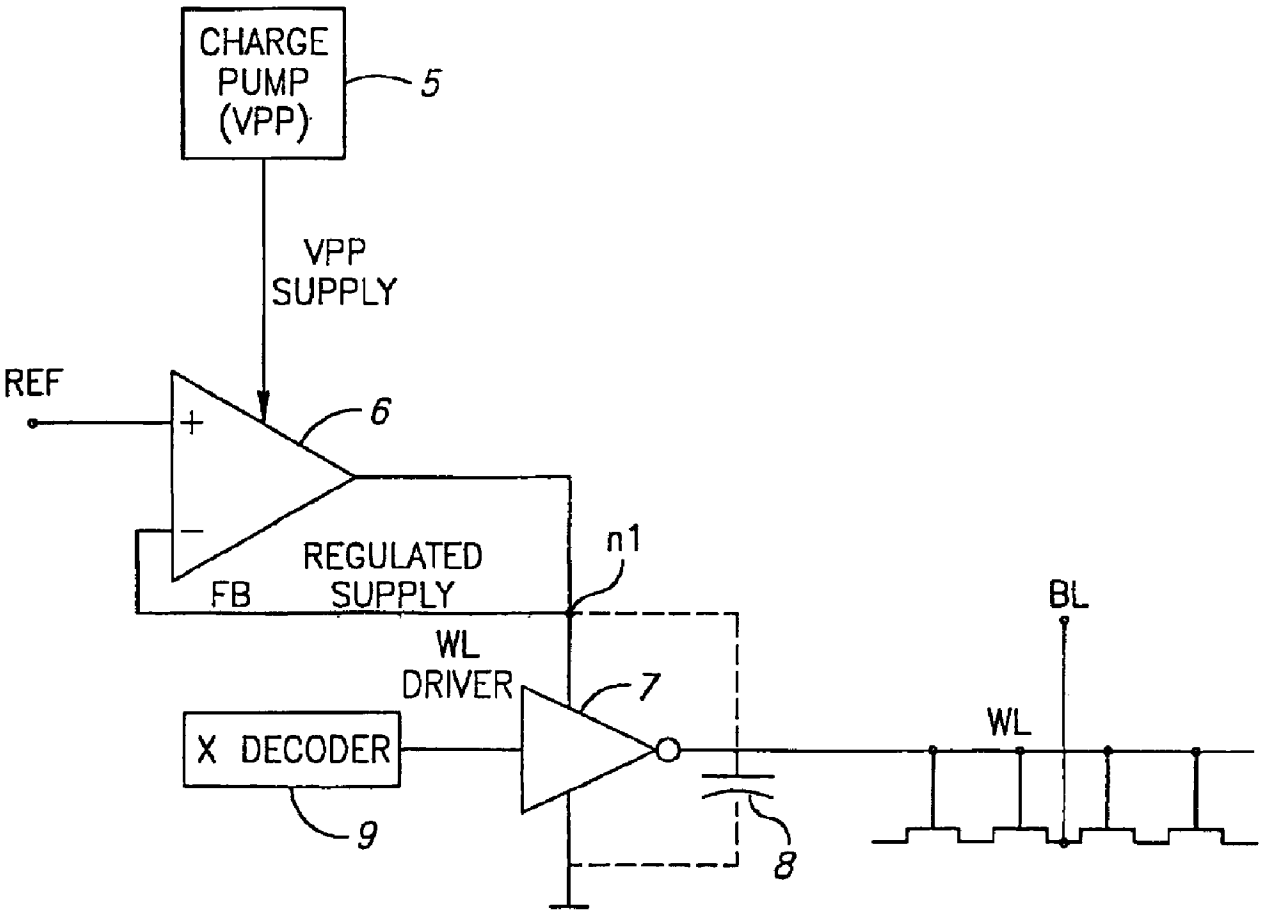
FIG. 1 is a simplified block diagram of a typical EPROM system with a charge pump to drive word line loads and to discharge the word lines between modes of programming and read/verify.

The capacitance load of the Class AB driver of FIG. 4 may be connected to the decoded word lines (WL) and/or word-line driver 7 in the memory array shown in FIG. 1.

Figure 5:
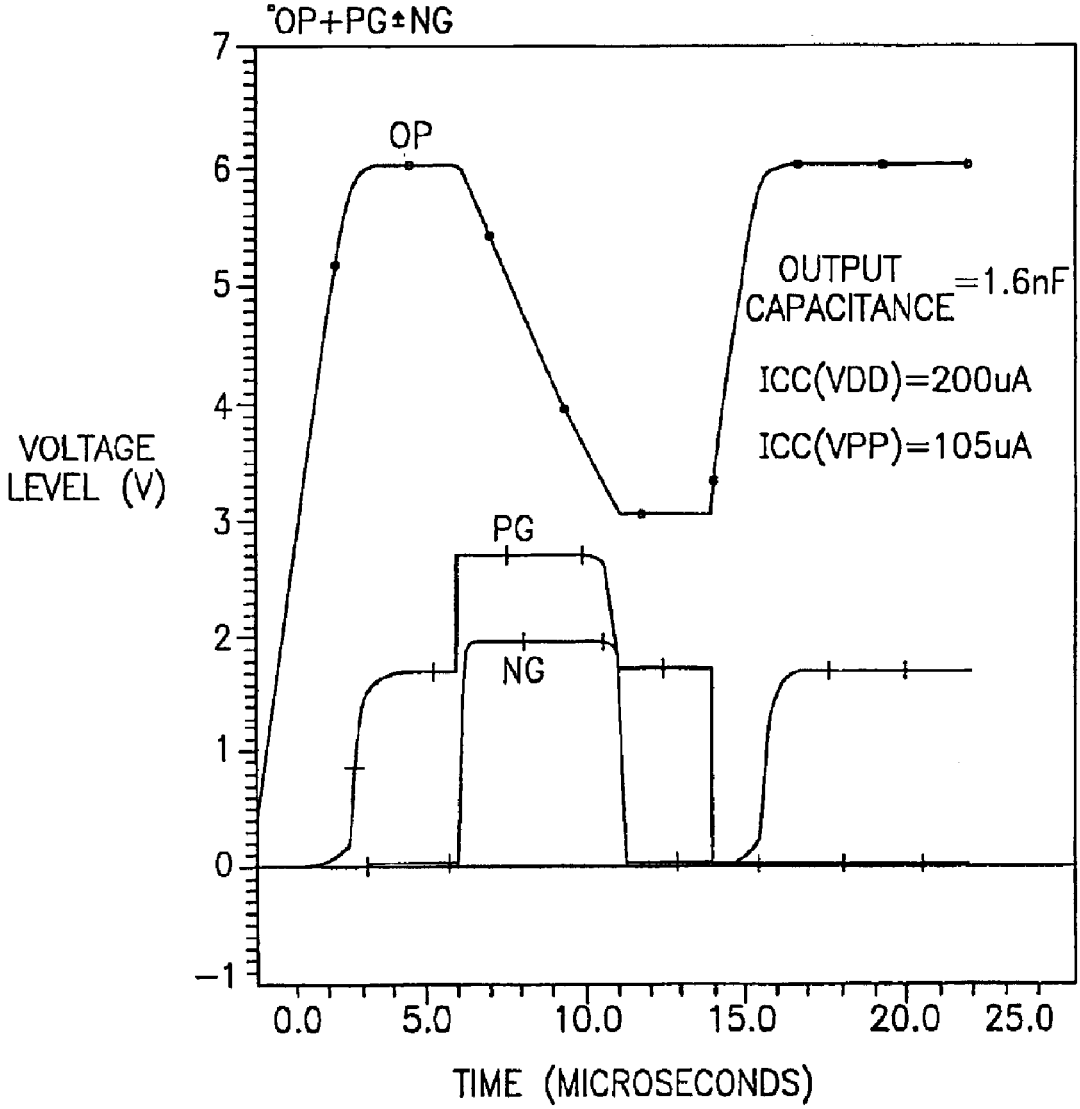
FIG. 5 is a simplified graph of a simulation of the Class AB voltage driver of FIG. 4, in accordance with an embodiment of the invention.

Reference is now made to FIG. 5, which illustrates a simulation of transitions between trim levels of the Class AB driver (also referred to as the voltage regulator or operational amplifier) of FIG. 4. Note that the trim level of the regulator may be adjusted by changing the ratio of the resistor divider (resistors R0 and R1 of FIG. 4). In the graph of FIG. 5, the y-axis is voltage levels supplied to the word lines of an array (in volts) and the x-axis is time (in microseconds).

In FIG. 5, the regulator is powered up from zero and makes a transition from a relatively high program verify level (e.g., 6V) to a relatively low erase verify level (e.g., 3V) and back to a VPP supply level (e.g., 6V). It is emphasized that the invention is not limited to these values. The WL and NWELL capacitance is 1.6 nF, while the steady state current consumptions are 105 $\mu$A from VPP and 200 $\mu$A from VDD. The steady state drive current of the output stage is 90 $\mu$A, while during transient conditions it is increased to approximately 1.2 mA. Since this regulator architecture has a very large output capacitor and a relatively weak second stage, it exhibits good PSRR characteristics (>60 dB), even out of the bandwidth. This is an important feature in EPROM applications, where VPP is a noisy pump supply.

In the embodiment of FIG. 4, the main driver (PMOS transistor M5A) in the current path of the second stage serves as the pull-up transistor and sourced current to VPP. The Class AB driver augments the pull down and serves as the current sink. It is possible to implement the invention the other way around, namely, with the main driver sinking current and the Class AB driver sourcing, as is now described with reference to FIG. 6.

In one non-limiting embodiment, NMOS transistor M1B may have its gate connected to an input "neg", its drain connected to node N10, and its source connected to node N11. Current source I1 may be connected to node N11 and grounded. NMOS transistor M1A may have its source connected to node N11, its gate connected to an input "pos", and its drain connected via node N13 to the drain of PMOS transistor M2A. PMOS transistor M2A may have its gate connected via node N13 to its drain, and its source may be connected to voltage VDD. PMOS transistor M2B may have its gate connected to the gate of PMOS transistor M2A, its drain to node N10, and its source may be connected to voltage VDD. The above components make up the first (differential) stage of the Class AB driver of FIG. 6.

The first stage may be connected at PG, that is, to the gate of PMOS transistor M3, which has its drain connected to node N14, and its source to VDD. NMOS transistor M4A may have its gate and drain connected to node N14, and its source may be grounded. NMOS transistor M4C (not M4B as in FIG. 4) may have its drain connected to node N16, its gate connected to the gate of NMOS transistor M4A, and its source may be grounded. NMOS transistor M4B may have its drain connected to a node N20, its gate connected to the gate of NMOS transistor M4C, and its source may be grounded. A current source I11 may be connected to node N20, and the other node of current source I11 may be connected to VPP.

The pair of NMOS transistors M6A and M6B may have their gates connected and their sources grounded. The drain of NMOS transistor M6A may be connected to its gate via a node ng connected to node N16. The drain of NMOS transistor M6B may be connected to the drain of PMOS transistor M5A. Current source I2 may be connected to node N16, and the other node of current source I2 may be connected to VDD.

The pair of PMOS transistors M5A and M5B may have their gates connected and their sources connected to VPP. The drain of PMOS transistor M5A may be connected to its gate via node N15. The drain of PMOS transistor M5B may be connected to the output node OP via node N20.

Figure 6:
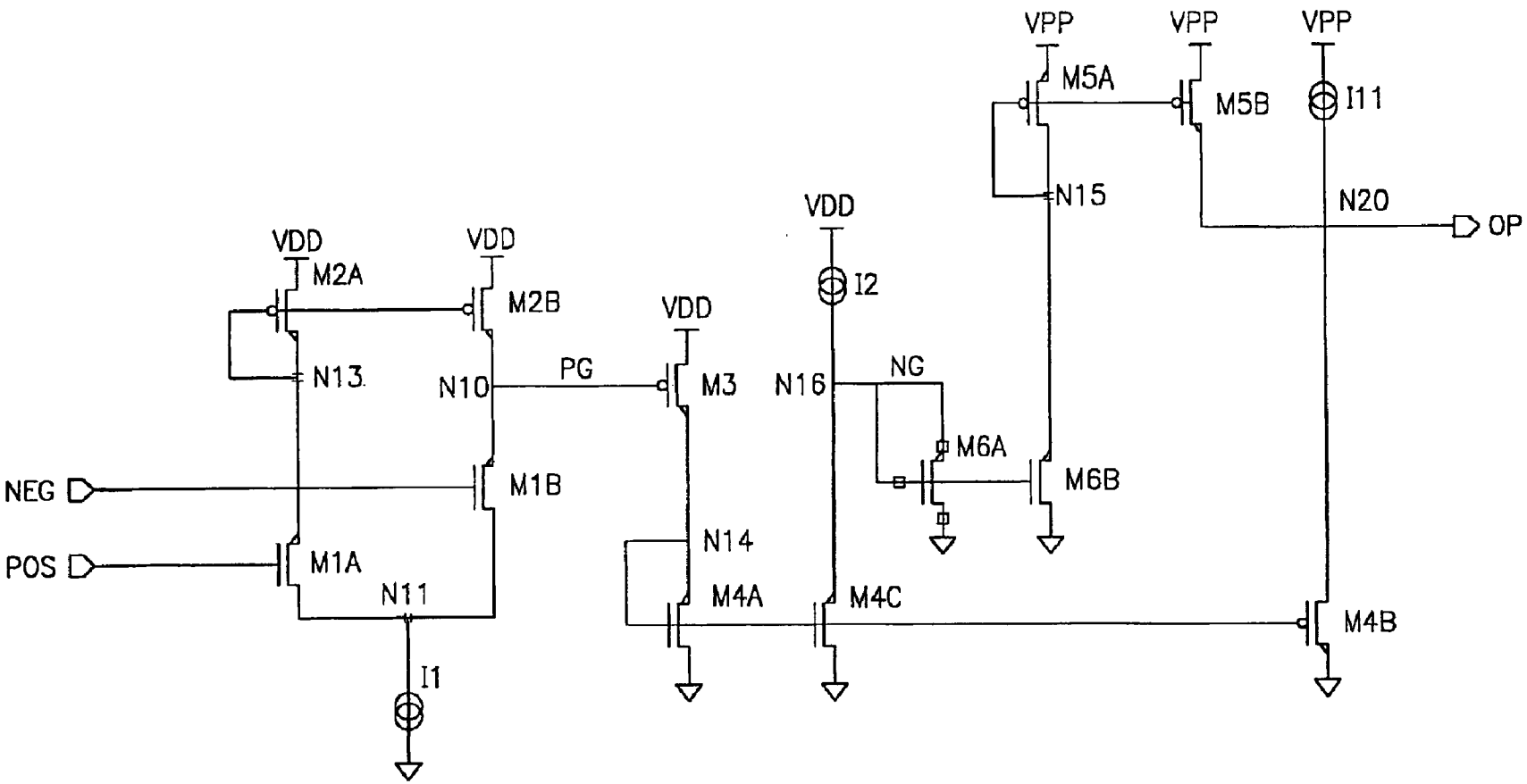
FIG. 6 is a simplified block diagram of circuitry for a Class AB voltage driver incorporating the voltage regulator of FIG. 3, in accordance with another embodiment of the invention.

In the embodiment shown in FIG. 6, the current in the second inverting stage (PMOS transistor M3) is mirrored to the output pull down NMOS transistor M4B, and provides sinking current to the output OP. The Class AB circuit, formed by NMOS transistor M4C, current source I2, and PMOS transistors M5A and M5B increases the sourcing current to VPP when the output is too low. The operational amplifier (driver) of FIG. 6 may drive a resistor divider (such as that shown in FIG. 4, comprising resistors R0 and R1) as a voltage regulator. Alternatively, the operational amplifier (driver) of FIG. 6 may drive a resistive/capacitive load and be used as an amplifier.

It will be appreciated by person skilled in the art, that the present invention is not limited by what has been particularly shown and described herein above. Rather the scope of the present invention is defined only by the claims that follow:

What is claimed is:

1. Circuitry comprising:

a voltage regulator comprising a first stage and a second stage, wherein an output of said first stage is coupled to an input of said second stage, wherein current of said second stage is minored through a current path to a current mirror driver, said current mirror driver adapted to perform a first Class AB action comprising at least one of sourcing and sinking current from a voltage supply VPP, wherein an output of said current mirror driver is connected to an output of said voltage regulator;

a first circuit connected to said current path and adapted to sample current in said current path, wherein during steady state current in said current path, said first circuit provides negligible current to the output of said voltage regulator, and during transient current conditions, said first circuit performs a second Class AB action complementary to said first Class AB action comprising at least one of sinking and sourcing current from the voltage supply VPP;

and wherein said first and second stages both operate from a voltage supply VDD, which is at a lower voltage than VPP.

2. The circuitry according to claim 1, wherein said first stage comprises a differential stage and said second stage comprises an inverting stage, and said input of said second stage is a gate of an MOS transistor.

3. The circuitry according to claim 1, wherein the output of said voltage regulator is connected to a capacitance load.

4. The circuitry according to claim 3, wherein said capacitance load comprises at least one of a wordline and a wordline driver of a memory array.

5. The circuitry according to claim 1, wherein the output of said first stage is coupled to a gate of said second stage without a Miller compensating capacitor.

6. The circuit according the claim 1, wherein said voltage regulator and said first and second stages form a two pole system based on an anti-Miller principle.

7. The circuitry according to claim 1, further comprising:

an NMOS transistor M1B whose gate is connected to an input BGREF, whose drain is connected to a node N10, and whose source is connected to a node N11;

a current source I1 connected to said node N11 and which is grounded;

an NMOS transistor M1A whose source is connected to said node N11, whose gate is connected to a node N12, and whose drain is connected via a node N13 to the drain of a PMOS transistor M2A, wherein said PMOS transistor M2A has its gate connected via said node N13 to its drain, and whose source is connected to voltage VDD;

and a PMOS transistor M2B whose gate is connected to the gate of said PMOS transistor M2A, whose drain is connected to said node N10, and whose source is connected to voltage VDD;

and further comprising:

a PMOS transistor M3 whose drain is connected to a node N14, whose source is connected to voltage VDD, and whose gate PG is connected to said first stage at said node N10;

an NMOS transistor M4A whose gate and drain are connected to said node N14, and whose source is grounded;

an NMOS transistor M4B whose drain is connected to a node N15, whose gate is connected to the gate of said NMOS transistor M4A, and whose source is grounded;

an NMOS transistor M4C whose drain is connected to a node N16, whose gate is connected to the gate of said NMOS transistor M4B, and whose source is grounded;

a current source I2, one node of which is connected to said node N16, and another node of which is connected to voltage VDD;

a pair of NMOS transistors M6A and M6B whose gates are connected together and to node N16 and whose sources are grounded, wherein the drain of said NMOS transistor M6A is connected to its gate and the drain of said NMOS transistor M6B is connected to the output of said voltage regulator;

a pair of PMOS transistors M5A and M5B whose gates are connected together and to node N15 and whose sources are connected to VPP, the drain of said PMOS transistor M5A being connected to said node N15, and the drain of said PMOS transistor M5B being connected to the output of said voltage regulator; and a resistor divider comprising a first resistor R0 connected between the output of said voltage regulator and a node N12, and a second resistor R1 connected between said node N12 and ground;

wherein said first stage comprises said current source I1, said transistors M1A, M1B, M2A and M2B, said second stage comprises said transistor M2, said current path comprises said transistors M4A and M4B, and said current mirror driver comprises said PMOS transistors M5A and M5B, and said first circuit comprises said NMOS transistors M4C, M6A, M6B and said current source I2.

8. The circuitry according to claim 1, further comprising:

an NMOS transistor M1B whose gate is connected to an input "neg", whose drain is connected to a node N10, and whose source is connected to a node N11;

a current source I1 connected to said node N11 and which is grounded;

an NMOS transistor M1A whose source is connected to said node N11, whose gate is connected to an input "pos", and whose drain is connected via a node N13 to the drain of a PMOS transistor M2A, wherein said PMOS transistor M2A has its gate connected via said node N13 to its drain, and whose source is connected to voltage VDD;

and a PMOS transistor M2B whose gate is connected to the gate of said PMOS transistor M2A, whose drain is connected to said node N10, and whose source is connected to voltage VDD;

and further comprising:

a PMOS transistor M3 whose drain is connected to a node N14, whose source is connected to voltage VDD, and whose gate PG is connected to said first stage at said node N10;

an NMOS transistor M4A whose gate and drain are connected to said node N14, and whose source is grounded;

an NMOS transistor M4C whose drain is connected to a node N16, whose gate is connected to the gate of said NMOS transistor M4A, and whose source is grounded;

an NMOS transistor M4B whose drain is connected to a node N20, whose gate is connected to the gate of said NMOS transistor M4C, and whose source is grounded;

a current source I11 one node of which is connected to a node N20, and another node of which is connected to voltage VPP;

a pair of NMOS transistors M6A and M6B whose gates are connected to each other and to node N16 via NG, and whose sources grounded, wherein the drain of said NMOS transistor M6A is connected to its gate and the drain of said NMOS transistor M6B is connected to the drain of a PMOS transistor M5A;

a current source I2 one node of which is connected to said node N16, and another node of which is connected to voltage VDD;

a pair of PMOS transistors M5A and M5B whose gates are connected to each other and to node N15 and whose sources are connected to VPP, wherein the drain of said PMOS transistor M5A is connected to its gate and the drain of said PMOS transistor M5B is connected to the output of said voltage regulator;

wherein said first stage comprises said current source I1, said transistors M1A, M1B, M2A and M2B, said second stage comprises said transistor M3, said current mirror driver and current path comprise said transistors M4A and M4B, and said first circuit comprises said NMOS transistors M4C, M6A, M6B, PMOS transistors M5A and M5B and said current source I2.

* * * * *